United States Patent [19]

Mendelsohn, deceased et al.

[11] 4,099,690

[45] Jul. 11, 1978

[54] STABILIZED KITE

[76] Inventors: Charles Richard Mendelsohn, deceased, late of Wyckoff, N.J., by Phyllis Jane Mendelsohn, executrix, 736 Terrace Heights, Wyckoff, N.J. 07481

[21] Appl. No.: 710,544

[22] Filed: Aug. 2, 1976

[51] Int. Cl.[2] ..... B64C 31/06

[52] U.S. Cl. ..... 244/153 R

[58] Field of Search ..... 244/153 R, 154, DIG. 1; D34/15 AF

[56] References Cited

U.S. PATENT DOCUMENTS

| | | | |
|---|---|---|---|
| 984,295 | 2/1911 | Peuvot | 244/154 |
| 1,356,381 | 10/1920 | McLaughlin | 244/154 |
| 2,488,118 | 11/1949 | Cobb et al. | 244/153 R |
| 3,347,500 | 10/1967 | Hartig | 244/153 R X |
| 3,796,399 | 3/1974 | Wechsler | 244/153 R |
| 3,963,200 | 6/1976 | Arnstein | 244/153 R |

OTHER PUBLICATIONS

Pelham, *The Penguin Book of Kites,* 1976.

*Primary Examiner*—Barry L. Kelmachter
*Attorney, Agent, or Firm*—Siegmar Silber

[57] ABSTRACT

A kite is described in which a wing of flexible material is disposed symmetrically about a central line; a wing spreader is structurally associated with the wing for providing equal and opposite extension forces operable at the central line; and an improved stabilizer is provided. The stabilizer has a keel depending from and structurally associated with the lower surface of the wing being attached thereto along one end of the central line, an apertured elevating cell through which air is drawn while kite is in flight with two side walls and upper and lower walls, the cell depending from and structurally associated with the lower surface of the wing along the other end of the central line, and a stabilizer strut for holding open the apertured elevating cell during flight being disposed between the keel and the lower wall of the apertured elevating cell.

13 Claims, 8 Drawing Figures

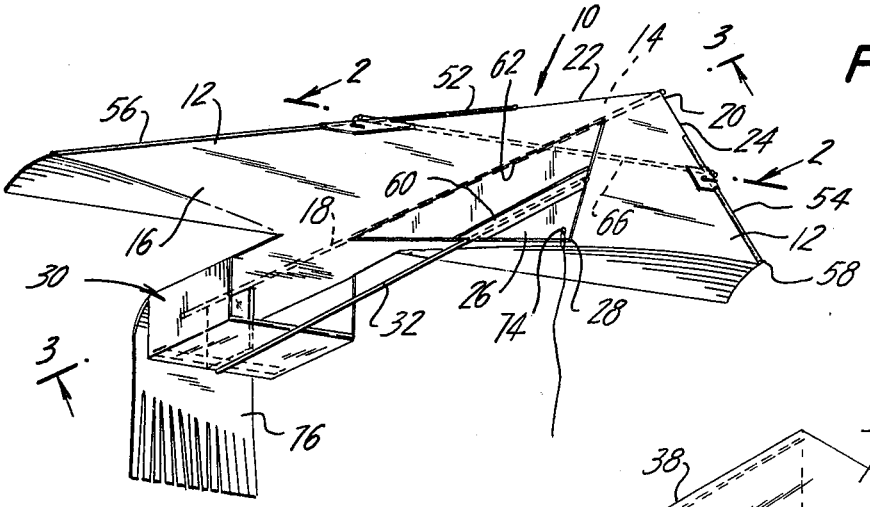
FIG. 1
FIG. 4
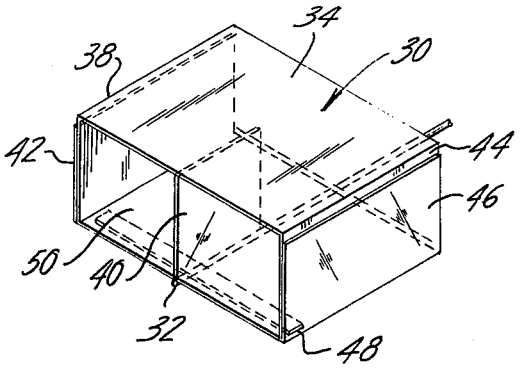
FIG. 2
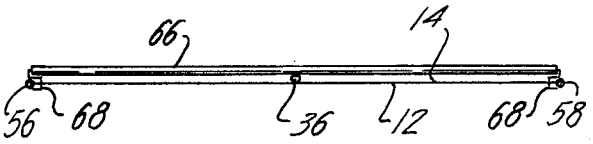
FIG. 5
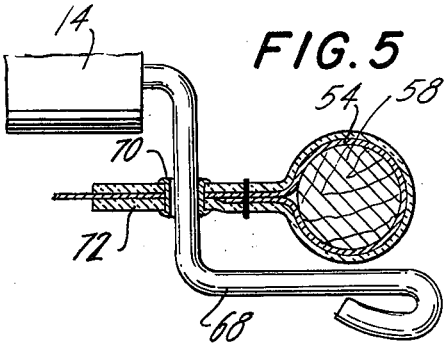
FIG. 3
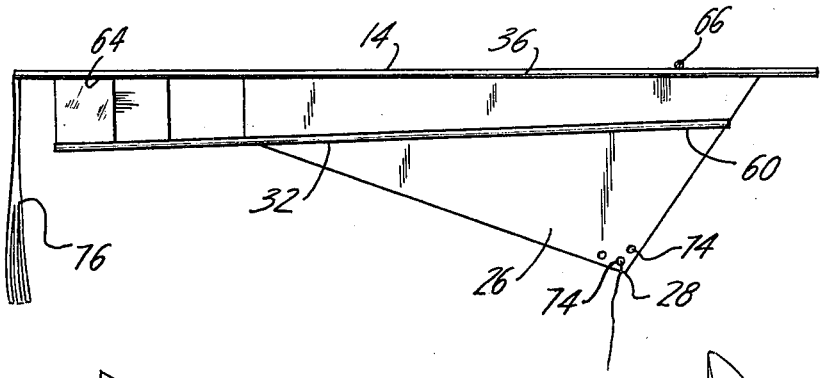
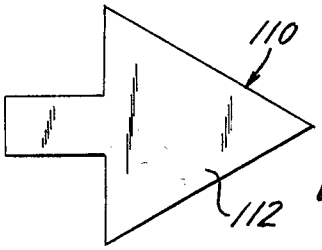
FIG. 6
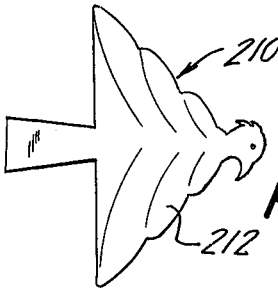
FIG. 7

STABILIZED KITE

BACKGROUND OF THE INVENTION

The present invention relates generally to kites, and more particularly to a kite of the stabilized type for flying under a broad range of wind conditions.

In the past, various structural aspects have been incorporated into kites for the purpose of stabilization thereof. These structures conform generally to aerodynamic principles as best understood by kite developers and aerodynamicists.

The classic or diamond-shaped kite employing a traditional bow tail and the stabilization such a tail provides is discussed in the patent to Wechsler U.S. Pat. No. 3,796,399.

The Wechsler patent teaches the use of a pair of open triangular cells for stabilization in combination with a relieved or vented wing in a tailless, Conyne-type kite.

Other attempts at stabilization have been through the use of keels. Keel kites as commonly constructed are adapted for flying under light to moderate wind conditions. A continuing problem with keel kites is that when air conditions become turbulent the kite loses stability and tears apart or crashes. Among the attempts to cure keel kite problems has been the rigidifying of the keel construction as in Christoffel U.S. Pat. No. 3,627,240.

A common difficulty to the above kites is limited range, e.g., classic diamond with bow tail—light to moderate (3 to 15 mph); Conyne-type—gentle to fresh (10 to 22 mph). Also, handling of the kites amid updrafts from trees and buildings is frequently problematic.

SUMMARY OF THE INVENTION

Thus the present invention describes a kite in which a wing of flexible material is disposed symmetrically about a central line; a wind spreader is structurally associated with the wing for providing equal and opposite extension forces operable at the central line; and an improved stabilizer is provided. The stabilizer has a keel depending from and structurally associated with the lower surface of the wind being attached thereto along one end of the central line an apertured elevating cell through which air is drawn while kite is in flight with two side walls and upper and lower walls, said cell depending from and structurally associated with the lower surface of the wing along the other end of the central line, and stabilizer strut for holding open the apertured elevating cell during flight being disposed between the keel and the lower wall of the apertured elevating cell.

Accordingly, it is an object of the present invention to provide a kite suitable for flying in light-to-strong winds, namely 3 to 30 mph.

It is an object of the present invention to provide a stabilization means equally applicable to both kites with tails and tailless kites.

It is another object of the present invention to provide improved kites capable of being launched in slight winds, ascending readily and planing in strong winds without overly loading the kite line.

It is yet another object to provide a stabilization system adaptable to many common kite wing shapes including but not limited to triangular, deltoid, pentagonal, and hexagonal.

The invention resides in the combination, construction, arrangement and disposition of the various component parts and elements incorporated in improved kites constructed in accordance with the principles of this invention. The present invention will be better understood and objects and important features other than those specifically enumerated above will become apparent when consideration is given to the following details and description, which when taken in conjunction with the annexed drawing describes, discloses, shows and illustrates a preferred embodiment of the present invention and what is presently considered and believed to be the best mode of practicing the principles thereof. Other embodiments or modifications may be suggested to those having the benefit of the teachings herein, and such other embodiments or modifications are intended to be reserved especially as they fall within the scope and spirit of the subjoined claims.

BRIEF DESCRIPTION OF THE DRAWINGS

With the above and additional objects and advantages in view as will hereinafter appear, this invention comprises the devices, combinations and arrangements of parts hereinafter described and illustrated in the accompanying drawing of a preferred embodiment in which:

FIG. 1 is a generally perspective view of the preferred embodiment;

FIG. 2 is a schematic cross-sectional view taken along line 2—2 in FIG. 1 showing the transverse strut arrangement;

FIG. 3 is a schematic cross-sectional view taken along line 3—3 in FIG. 1 showing the longitudinal and stabilizer strut arrangement;

FIG. 4 is an enlarged fragmentary perspective view of the rearward stabilizer and associated stabilizer strut;

FIG. 5 is an enlarged fragmentary schematic cross-sectional view of one end of transverse strut;

FIG. 6 is a top plan view of a first alternate embodiment of the kite pursuant to the present invention;

FIG. 7 is a top plan view of a second alternate embodiment of the kite pursuant to the present invention.

DESCRIPTION OF THE PREFERRED EMBODIMENT

Figure 8:
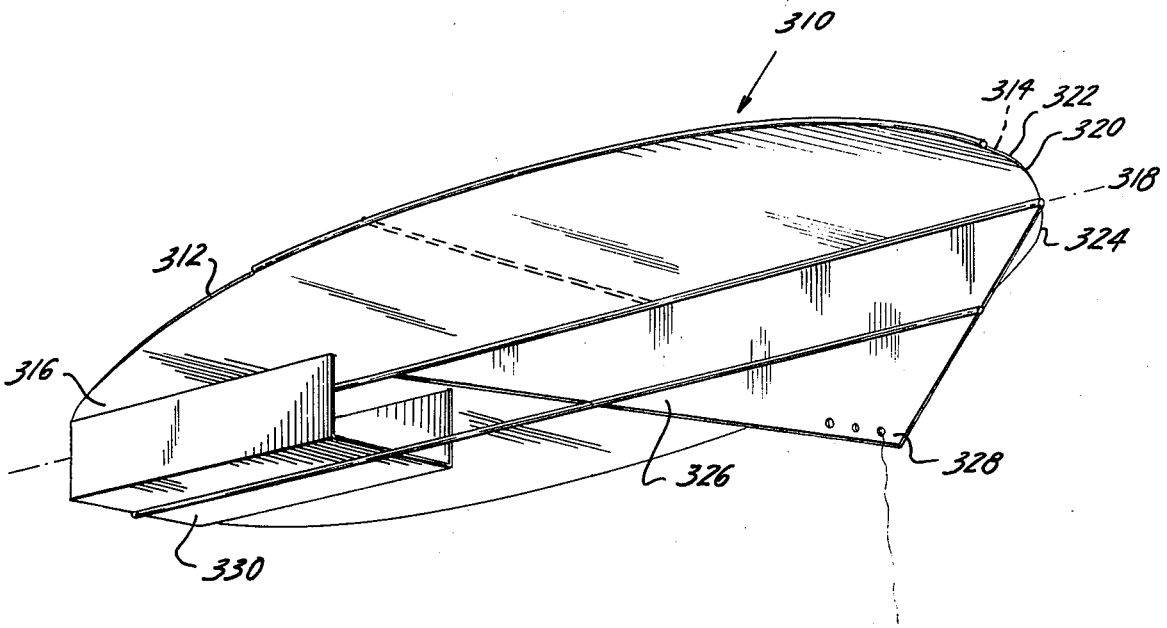
FIG. 8 is a generally perspective view of a third alternate embodiment of the kite pursuant to the present invention.

Referring now to the drawings, and more particularly to FIGS. 1 through 5, the preferred embodiment of the present invention relates generally to a stabilized kite adapted for operation under a wide range of ambient air speeds. The kite, referred to generally by the reference designator 10, has a wing or body 12, FIG. 1 with selected portions thereof held under tension or stretched conditions as further described below so as to be disposed in a substantially planar manner. The wing 12 is defined by an upper surface 14 and lower surface 16.

While the wing 12 may be any of numerous shapes—triangular; deltoid; rectangular; pentagonal; symmetrical about longitudinal axis such as arrowhead, eagle, gull, and the like; the body shape shown in the preferred embodiment is basically triangular. The triangular wing or body 12 is further defined by a centrally located central line or longitudinal axis 18 that bisects at the front of the wing the leading angle or apex 20. The leading angle or apex 20 is in turn defined by the leading edges 22 and 24 of the wing. In a rectangular wing, the apex angle is 180° or 90°; however, in the preferred embodiment the angle is approximately 70°.

Depending from the wing portion of the kite is a keel or keel portion 26 structured to assume during flight of the kite a position lying within a plane that includes the central line or longitudinal axis 18, said plane being substantially normal to the plane of the wing. On symmetrical, but nonplanar wing shapes, such as bird-like shapes having two joined, concave wing surfaces, the wing plane for purposes of the definition herein is further defined by two correspondingly positioned points in each of the wing surfaces and by a point on the central line such as the apex. The keel is commonly structured as a triangular body with a keel apex 28 defined as the point of the keel extending farthest away from the wing plane. In the triangular wing, as shown by the preferred embodiment, the keel portion is substantially adjacent the leading angle of the kite.

Rearward along the central line is found a stabilization or apertured elevating cell, generally indicated by reference designator 30 and shown in detail in FIG. 4. The construction of the stabilization cell 30 is best understood when discussed as hereinbelow in the fully open position as would be assumed during flight of the kite with forces operating to place the wing in a substantially planar and horizontal condition and the keel in a substantially planar and vertical condition. Besides the keel and stabilization cell being structurally associated with the common wing portion, the two elements are interconnected by a keel cell strut or stabilization strut means 32 which is operationally described below. The structure of the elevating cell is further defined by an upper cell wall 34 shown herein as being coplanar with the wing, extending on either side of a spine 36, a right cell wall 38 cell dividing wall 40, and a left cell wall 44. The cell walls 38 and 44 have stiffening or reinforcement means 42 and 46, respectively, attached thereto. Similarly, lower cell wall 50 is structured to accomodate stiffening means or transverse cell strut 48. The cell walls 38, 40 and 44 are disposed in the preferred embodiment in planes parallel to that of the keel whereas cell walls 34 and 50 are disposed in planes parallel to or identical to the wing plane.

In the preferred embodiment well-known means are employed for supporting and extending the triangular wing. The leading edges of the wing are supported by wing support pockets 52 and 54 housing therein leading edge stiffening means 56 and 58, respectively. These stiffeners may be housed adjacent to or spaced rearwardly form leading angle 20 so as to provide differing flexibility of the overall kite with the forward/rearward displacement of the stiffening means.

Also, in the preferred embodiment in which the design provides for a spine 36, shown herein as a dowel 64 structurally associated with the triangular wing 12 and housed in a pocket 62, additional longitudinal wing support is gained. Similar longitudinal support is indirectly gained from keel/cell strut 32 housed in a pocket 60. The dowels 32 and 64 are restrained by the pocket arrangement described above thereby resulting in the extension or spreading of the wing surface. Transverse wing support is provided by a strut 66 shown in the cross sectional view FIG. 2 and the attachment detail in FIG. 5. The strut 66 is supported external to wing 12 by end clip means or fasteners 68 for cooperative relation with eyelets 70 adjacent leading edge strut 58. The kite 10 is reinforced by plastic tabs 72, preferably formed from Mylar sheeting on both sides of wing 12 and surrounding eyelets 70.

The kite 10 is tethered through one of several eyelets 74 adjacent keel apex 28.

Other embodiments are shown in FIGS. 6 and 7 in which kites 110 and 210 with respective wing shapes 112 and 212 are illustrated.

Referring now to the drawings, and more particularly to FIG. 8 yet another embodiment of the present invention relates generally to a stabilized kite adapted for operation under a wide range of ambient air speeds. In FIG. 8, those portions indicated as 300 series designators have corresponding elements in the preferred embodiment, FIG. 1. The kite, referred to generally by the reference designator 310. FIG. 8, has an elliptical wing or body 312 with selected portions thereof held under tension or stretched conditions as further described below so as to be disposed in a substantially planar manner. The wing 312 is defined by an upper surface 314 and lower surface 316.

As previously described, the wing 312 may be any of numerous shapes, the body shape shown in the additional embodiment is basically elliptical. The elliptical wing or body 312 is further defined by a centrally located central line or major axis 318 that bisects at the front of the wing the nose or apex portion 320. The nose or apex portion 320 is in turn defined by the leading edges 322 and 324 of the wing.

Depending from the wing portion of the kite is a keel or keel portion 326 structured to assume during flight of the kite a position lying within a plane that includes the central line or major axis 318, said plane being substantially normal to the plane of the wing. On symmetrical, but nonplanar wing shapes such as bird-like shapes having two joined, concave wing surfaces, the wing plane for purposes of the definition herein is further defined by two correspondingly positioned points in each of the wing surfaces and by a point on the central line such as the apex. The keel is commonly structured as a triangular body with a keel apex 328 defined as the point of the keel extending farthest away from the wing plane. In the elliptical wing, as shown in this embodiment, the keel portion is substantially adjacent the nose of the kite.

Rearward along the central line is found a stabilization or apertured elevating cell 330 and is identical to that structure as shown in detail in FIG. 4 generally indicated by designator 30, and described hereinabove.

As to materials, it has been found that modern synthetic fabrics of the industrial nylon variety, including ripstop, or spinnaker nylon, and plastic film, or sheet, such as polyethylene and Mylar are preferably for the kite cover or wing material of this invention. A number of synthetic fabrics, woven from artificial fibers including rayon, nylon, Terylene or Dacron yarn are available in many grades of weight and porosity. In their lighter, more closely woven grades the fabrics made therefrom are strong and supple, easily workable and realtively inexpensive. Ripstop, or spinnaker nylon, a high-performance fabric reinforced with a monofilament grid, originally developed for the sails of racing yachts, is one of the best cover fabrics available, If properly used it is virtually indestructible, and is manufactured in a wide range of weights, porosity ratings, and colors. Polyethylene or similar thermoplastics of high flexibility and strength are available in sheet or film form. The thermoplastics are quick and easy to work and can be joined either by pressure-sensitive tape or suitable cement; though being thermoplastic it can also be heat-sealed. The strut or framing of this invention also may be selected from a wide choice of materials including ash or spruce dowels, plastic extrusions and tubing, metal extrusions and tubing, and bamboo.

In operation, the kite provides maneuverability in gentle winds as low as 3 miles per hour and in strong winds as high as 30 miles per hour. In lauching the kite, it will assume an ascending attitude and continue to ascend until the lift forces on the wing approaches the downward forces, i.e., weight of the kite line, downward pull of the operator, etc. When the equilibration point is approached the kite begins to "plane" or assume a substantially horizontal position. The air currents then under the wing enter the forward aperture of the elevating cell and fills the cell(s) with air. It is believed, although not fully understood, that the air forced through the cell(s) causes the lower cell wall and the upper cell wall to act as wing services and the left, right and center cell walls to act additional keel area. The keel/cell strut serves the kite in the flying mode by holding open the elevating cell through the transmission of downward forces exerted upon the kite line.

What is claimed is:

1. A kite comprising:

a wing portion of flexible material disposed symmetrically about a central line;

wing spreading means structurally associated with said wing portion for providing equal and opposite extension forces operable at said central line; and stabilizer means for stabilizing the kite during flight further comprising;

a substantially triangular keel portion depending from and structurally associated with the lower surface of said wing portion being attached thereto along one end of said central line, said wing portion and said keel portion during flight being substantially perpendicular;

at least one apertured elevating cell through which air is drawn while the kite is in flight each said cell having two side walls and upper and lower walls, each said cell depending from and structurally associated with the lower surface of said wing portion along the other end of said central line; and stabilizer strut means for holding open each said apertured elevating cell during flight being disposed between said keep portion and said lower wall of each said apertured elevating cell.

2. A kite as described in claim 1, wherein said wing portion is a triangular body and, upon extension, is substantially disposed in a plane in which said central line is coincident with the longitudinal axis of said triangular body and bisects the leading angle of said triangular body.

3. A kite as described in claim 2 wherein the sides of said triangular body adjacent said leading angle are defined as leading edges and the side of said triangular body opposite said leading angle is defined as the trailing edge and wherein said wing spreading means include first leading edge stiffening means for wing edge stiffening extending along and attached to a substantial portion of one of said leading edges and spaced from said leading angle a predetermined distance toward said trailing edge;

second leading edge stiffening means for wing edge stiffening attached to the other one of said leading edges; and transverse strut means for providing wing spreading extension forces attached under tension to said first and said second stiffening means at points equally spaced from said leading angle, said transverse strut means in cooperative coaction with said first and said second stiffening means.

4. A kite as described in claim 3 wherein said wing spreading means further includes longitudinal strut means for stiffening wing center disposed along said central line and attached thereto.

5. A kite as described in claim 1 wherein said side walls of each said apertured elevating cell are reinforced so that during the flight of said kite under gentle wind conditions each said apertured elevating cell is held partially open.

6. A kite as described in claim 1 wherein said kite further comprises correction means for tethering kite lines to said keel portion and a kite line attached thereto whereby during flight of said kite with lifting forces exerted upwardly upon the lower surface of said wing portion and with a downward force exerted upon said kite line, a downward force is transmitted by said stabilizer strut means to said lower wall of each said apertured elevating cell.

7. A kite as described in claim 1, wherein said wing portion is a polygonal body and, upon extension, is substantially disposed in a plane in which said central line divides said body into two symmetrical portions and in which said central line exits from said wing portion at a leading angle at one end thereof.

8. A kite as described in claim 7 wherein the sides of said wing portion adjacent said leading angle are defined as leading edges and the side of said wing portion opposite said leading angle is defined as the trailing edge and wherein said wing spreading means include first leading edge stiffening means for wing edge stiffening extending along and attached to a substantial portion of one of said leading edges and spaced from said leading angle a predetermined distance toward said trailing edge;

second leading edge stiffening means for wing edge stiffening attached to the other one of said leading edges; and transverse strut means for providing wing spreading extension forces attached under tension to said first and said second stiffening means at points equally spaced from said leading angle, said transverse strut means in cooperative coaction with said first and said second stiffening means.

9. A kite as described in claim 8 wherein said wing spreading means further includes longitudinal strut means for stiffening wing center disposed along said central line and attached thereto.

10. A kite as described in claim 1, wherein said wing portion is an elliptical body and, upon extension, is substantially disposed in a plane in which said central line is coincident with the major axis of said elliptical body and divides said body into two symmetrical portions and in which said central line exits from said wing at a leading angle at one end thereof.

11. A kite as described in claim 10 wherein the edges of said elliptical body adjacent said leading angle are defined as leading edges and the edge portion of said elliptical body opposite said leading angle is defined as the trailing edge and wherein said wing spreading means include first leading edge stiffening means for wing edge stiffening extending along and attached to a substantial portion of one of said leading edges and spaced from said leading angle a predetermined distance toward said trailing edge;

second leading edge stiffening means for wing edge stiffening attached to the other one of said leading edges; and transverse strut means for providing wing spreading extension forces attached under tension to said first and said second stiffening means at points equally spaced from said leading angle, said transverse strut means in cooperative coaction with said first and said second stiffening means.

12. A kite as described in claim 11 wherein said wing spreading means further includes longitudinal strut means for stiffening wing center disposed along said major axis and attached thereto.

13. A kite as described in claim 1 wherein said stabilizer means is for stabilizing the kite under wind conditions of from 3 to 30 miles per hour.

* * * * *

UNITED STATES PATENT OFFICE

CERTIFICATE OF CORRECTION

Patent No. 4,099,690 Dated July 11, 1978

Inventor(s) Charles Richard Mendelsohn , deceased

It is certified that error appears in the above-identified patent and that said Letters Patent are hereby corrected as shown below:

On the cover sheet, item [76] after "executrix" -- and Phyllis Jane Mendelsohn -- should be inserted.

Signed and Sealed this

Seventh Day of November 1978

[SEAL]

Attest:

RUTH C. MASON
*Attesting Officer*

DONALD W. BANNER
*Commissioner of Patents and Trademarks*